US006095209A

United States Patent [19]

LeClair

[11] Patent Number: 6,095,209

[45] Date of Patent: Aug. 1, 2000

[54] APPARATUS FOR AUTOMATICALLY FORMING ROUNDED CORNERS ON A PLANAR MEMBER

[76] Inventor: Wayne S. LeClair, 21706 W. Lunn Rd., Strongsville, Ohio 44136

[21] Appl. No.: 09/379,079

[22] Filed: Aug. 23, 1999

Related U.S. Application Data

[60] Provisional application No. 60/097,902, Aug. 26, 1998.

[51] Int. Cl.[7] ..... B27C 5/00

[52] U.S. Cl. ..... 144/135.2; 144/137; 144/253.2; 144/183; 409/183

[58] Field of Search ..... 144/2.1, 134.1, 144/135.2, 136.1, 136.9, 137, 149, 253.1, 253.2, 253.4, 253.5, 286.1, 286.5; 409/183, 218, 219

[56] References Cited

U.S. PATENT DOCUMENTS

| | | | |
|---|---|---|---|
| 3,994,326 | 11/1976 | Sarten . | |
| 4,102,374 | 7/1978 | Klein . | |
| 4,112,987 | 9/1978 | Pachnik . | |
| 4,294,297 | 10/1981 | Kieffer . | |
| 4,524,812 | 6/1985 | Murphy | 144/135.2 |
| 4,913,206 | 4/1990 | Altinbasak . | |
| 5,038,841 | 8/1991 | Larmon . | |
| 5,063,983 | 11/1991 | Barry . | |
| 5,203,389 | 4/1993 | Goodwin . | |
| 5,345,986 | 9/1994 | Kieffer . | |
| 5,823,239 | 10/1998 | Smith | 144/134.1 |
| 5,908,061 | 6/1999 | Blichmann | 144/135.2 |
| 6,019,148 | 2/2000 | Hansen | 144/135.2 |

*Primary Examiner*—W. Donald Bray
*Attorney, Agent, or Firm*—Fay, Sharpe, Fagan, Minnich & McKee, LLP

[57] ABSTRACT

An apparatus for automatically forming rounded corners on a planar member is disclosed. The apparatus includes a support structure, a work surface, a cutting tool, a motor to drive the cutting tool, and an assembly to arcuately move and position the cutting tool to thereby form a desired rounded corner on a member placed in the apparatus. The apparatus automatically and consistently forms arcuate corners or other desired shapes on planar members, such as countertops or boards.

16 Claims, 5 Drawing Sheets

APPARATUS FOR AUTOMATICALLY FORMING ROUNDED CORNERS ON A PLANAR MEMBER

CROSS REFERENCES TO RELATED APPLICATIONS

The present application claims priority from U.S. Provisional application Serial No. 60/097,902 filed on Aug. 26, 1998.

FIELD OF THE INVENTION

The present invention relates to an apparatus for readily forming rounded corners on planar members such as countertops or boards. The apparatus accurately, consistently, and quickly rounds or otherwise shapes the edges and corners of such members.

BACKGROUND OF THE INVENTION

There are primarily three techniques for forming rounded corners on planar members such as countertops and boards. The first method is a free-hand method in which an artisan or a carpenter marks the desired shape on the member, such as with a pencil, and cuts along the mark to form the desired corner shape. Even the most skilled carpenters may not be able to form the desired corner shape with consistency using the free-hand method. The marked line may not accurately represent the desired corner shape. Or, the carpenter may inadvertently move the cutting tool off the marked line, resulting in a rough curve. This free-hand method can also be very time consuming.

The second method involves using a cutting guide or template to form a rounded curve or other corner shape. Instead of following a line that the carpenter previously marked on a board, the template is placed on top of the board to be cut and the cutting device, such as a saw, is inserted into the template. The template provides a predefined shape for cutting. Manually aligning and positioning the template to achieve the desired rounded corner can be very time consuming. Moreover, movement, even very slight, between the template and the member to be cut causes inaccuracies in the resulting shape of the final cut corner.

Another method of forming rounded corners involves using a cutting device mounted to a radial arm, in which the radial arm pivots about a fixed point. Depending upon the placement of the cutting device on the arm, the radius of the rounded corner may be lengthened or shortened. Large radius arms may be easy to set up, however large radius arms are limited to forming only large rounded shapes. In order to form corners or shapes with smaller radii, a smaller arm must be used. Using smaller armed assemblies may require an assembly to be mounted to the board each time a different corner of the board needs to be rounded or otherwise shaped. The mounting and dismounting of the assembly every time a rounded corner is to be cut, can be very time consuming.

To overcome these and other limitations associated with prior art techniques and devices, a need exists for an apparatus and related process that can quickly, accurately and consistently cut or otherwise form rounded corners in planar members.

SUMMARY OF THE INVENTION

In a first aspect, the present invention provides an apparatus for shaping corners on a planar member. The apparatus comprises a support structure, a work surface affixed to the support structure, a movable plate underneath the work surface, an actuating assembly also positioned under the work surface and connected to the movable plate, and a motor and cutting tool secured to the movable plate. The work surface includes a cutting tool opening extending through its thickness, a squaring guide secured along the top surface of the work surface and a cutting tool shield that is secured on the top surface of the work surface and generally over the cutting tool opening. The motor and cutting tool are secured to the movable plate and movable therewith such that upon actuation of the actuating assembly, the cutting tool is selectively moved within the cutting tool opening thereby shaping or otherwise forming a corner of a planar member positioned on the work surface.

In another aspect, the present invention provides an apparatus for forming rounded corners on a planar member. The apparatus comprises a support structure, a generally planar work surface disposed on and affixed to the support structure, a squaring guide, a cutting tool shield, a pivotable member situated underneath the work surface, a selectively extendable member coupled to the pivotable member, and a cutting assembly secured to the pivotable member. The work surface includes a cutting tool opening which receives the cutting tool extending from below the work surface. The pivotable member under the work surface may be moved within a horizontal plane generally parallel to and below the work surface. Upon movement of the pivotable member, the cutting assembly, attached thereto, moves generally through an arc within the cutting tool opening defined in the work surface.

In yet another aspect, the present invention provides a device adapted for forming rounded corners on a countertop. The device comprises a support assembly, a work top positioned on the support assembly, and a selectively positionable member affixed to and generally located below the work top. The device further includes a motor secured to the positionable member, and a cutting tool attached to the output shaft of the motor. Upon actuation of an actuating assembly, the positionable member, the motor, and the cutting tool are moved generally within a horizontal plane below the work top such that the cutting tool, extending through a cutting aperture in the work top, moves within a predefined arcuate path.

These and other features and advantages of the present invention will become better understood with regard to the following description, appended claims, and accompanying drawings.

DETAILED DESCRIPTION OF THE PREFERRED EMBODIMENTS

Figure 1:
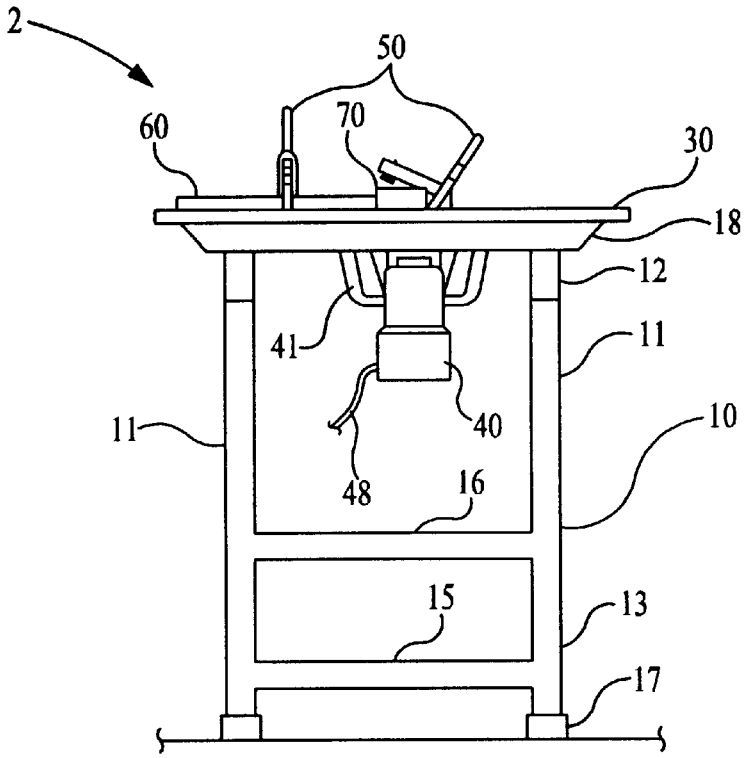
FIG. 1 is an elevational view of a preferred embodiment apparatus in accordance with the present invention.

The present invention provides a device for cutting or forming rounded corners on planar members consistently, precisely, quickly and inexpensively. The present invention provides a device for automatically forming rounded corners or other desired shapes on a planar member secured within the device. The preferred embodiment device includes a number of features as follows.

The preferred device includes a table assembly having a generally horizontal work surface. Preferably mounted on the work surface is a shield or hood that covers an opening defined in the work surface. Also preferably mounted on the work surface are a squaring guide and clamping devices to help guide and hold the planar member over a cutting tool that extends upward through the opening while the corner is formed on the planar member.

The device further includes an electric motor that is pivotally mounted to the work surface. The motor drives the cutting tool. The motor is preferably positioned under the work surface so that the cutting tool extends upward and through the opening in the work surface. The pivotally fastened motor is secured along the underside of the work surface, yet may pivot along an arc as described in greater detail herein.

The motor is preferably moved by one or more pneumatic cylinders. Preferably, the pneumatic cylinders utilize a powered or pressurized extension and retraction configuration. The pneumatic cylinders and associated airlines and valving are preferably disposed under the work surface and used to move the motor along an arcuate path, thereby moving the cutting tool along a similar arcuate path within the opening in the work surface. A single dual action cylinder can extend and retract to selectively position and move the motor and cutting tool. Alternatively, two single action cylinders can be used to selectively move and position the motor and cutting tool.

A pair of clamps or other securing members are preferably provided along the top of the work surface for clamping or otherwise securing a countertop or other planar member in place before and during rounding of its corners by the device. These clamps may be operated individually or by using pneumatic pressure accessible from the previously noted pneumatic cylinders and airlines used to move the motor and cutting tool.

The device is used by placing a planar member, such as a counter top, having a square or undesired corner that is to be rounded or otherwise shaped, on the work surface. The planar member is oriented so that the corner is positioned over the opening in the work surface, and generally within the shield. Upon proper positioning of the member, the clamps are engaged with the member to hold it firmly in place. The motor and cutting tool are then actuated and the air circuit operated to pivot the motor and cutting tool along an arc under the work surface. Accordingly, the cutting tool forms a rounded corner along the region, i.e. the corner, of the member that is positioned over the opening.

Figure 2:
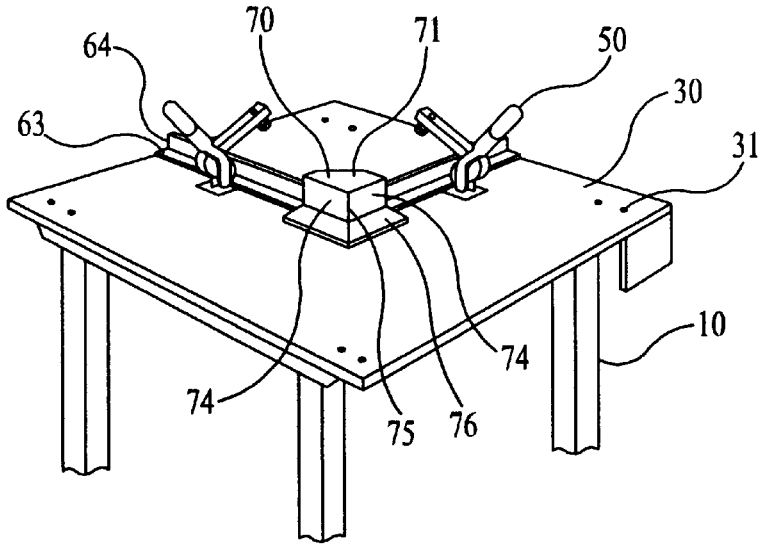
FIG. 2 is a partial perspective view of a work surface of the preferred embodiment apparatus illustrated in FIG. 1.
Figure 3:
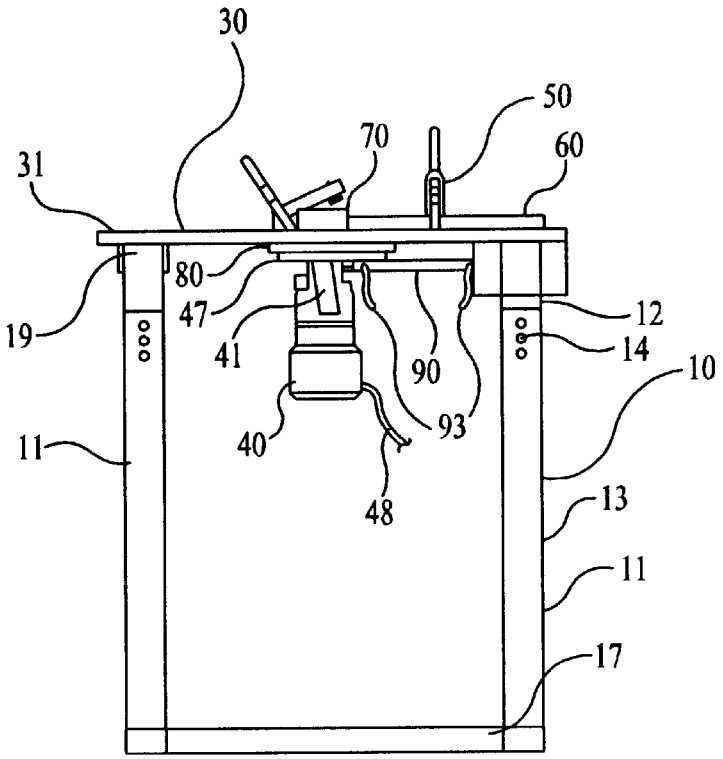
FIG. 3 is another elevational view of the preferred embodiment apparatus in accordance with the present invention.

Additional details of a preferred embodiment apparatus in accordance with the present invention are as follows. The preferred apparatus comprises a number of features as shown in the referenced drawings. FIG. 1 illustrates the preferred apparatus 2 for forming rounded corners on a planar member comprising a support structure 10, a work surface 30, and a motor 40 which drives a cutting tool 43 shown in FIG. 8. The preferred support structure 10 illustrated in FIGS. 1 to 4 includes four adjustable legs 11, each leg 11 comprised of an upper portion 12 which is mounted on, or coupled to, a lower portion 13. The legs 11 contain several apertures or holes 14 near the top of the lower portion 13 and the bottom of the upper portion 12, as best shown in FIG. 3. The holes 14 in the legs 11 can be aligned with a fastening device such as a bolt, to adjust the height of the work surface 30. Returning to FIG. 1, in the preferred embodiment, a lower horizontal brace 15 and an upper horizontal brace 16 spanning the lower portion 13 of the legs 11 are located on opposite sides of the support structure 10. A top horizontal support beam 18 spans the upper portion 12 of the legs 11 on the same sides as the lower horizontal braces 15,16. The top horizontal beam 18 extends slightly over the support structure 10 legs 11 to form a cantilevered edge. In the preferred embodiment as seen in FIG. 3, holes or apertures 19 in the horizontal beam 18 align with holes or apertures 31, as seen in FIG. 2, in the work surface 30 thereby allowing fastening devices such as bolts to affix the work surface 30 to the support structure 10. Other ways exist to mount the work surface 30 to the support structure 10 such as welding the work surface 30 to the support structure 10. On the adjacent side of the horizontal braces 15,16 a floor brace 17 spans the lower portion 13 of the legs 11. In the preferred embodiment, the support structure 10 is made from steel or a similar material sturdy enough to support the work surface 30, the items mounted to the work surface 30, and the planar member. In the preferred embodiment, the floor brace 17 is comprised of wood to allow the support structure 10 to be easily secured to the floor. However, wood is not required and any suitable material that can be secured to the floor, such as metal, will suffice. The distance between the legs 11 is determined by the amount of work area needed. A minor proportion of the work surface 30 may cantilever or otherwise extend over the square or rectangle shaped footprint formed by the legs 11.

Mounted on top of the support structure 10 is a horizontally flat work surface 30. The work surface 30 is preferably mounted on the top horizontal support beam 18. The work surface 30 is preferably a square or rectangular shaped piece of metal or other suitable rigid material able to support, among other things, a planar member, such as a board or countertop. The work surface 30 needs to be large enough to adequately support a planar member and the other components described herein that assist in aligning the planar member while its corner is being rounded or otherwise shaped. The work surface 30 also needs to be thick enough so that it remains rigid and will not deflect when loaded with the other components mounted to the work surface 30 described herein. As best illustrated in FIG. 2, the work surface 30 preferably defines one or more apertures 31 which are aligned with holes 19 in the top horizontal beam 18. Fasteners are inserted through the holes 31 and 19 to secure the work surface 30 to the support structure 10. The particular work surface 30 in the preferred embodiment is approximately a four feet square, one-half inch thick steel or aluminum plate.

Figure 4:
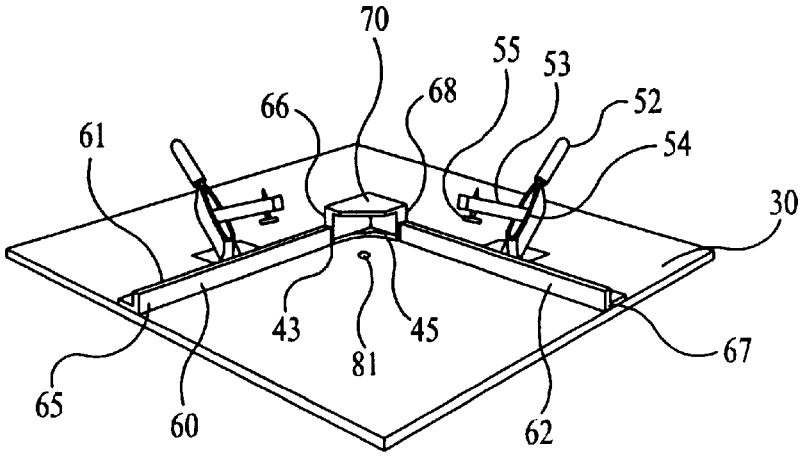
FIG. 4 is a detailed partial perspective view of the work surface of the preferred embodiment apparatus.

FIGS. 1 and 2 illustrate several additional components of the preferred embodiment apparatus 2 such as one or more clamping devices 50, a squaring guide 60, and a cutting tool shield 70 mounted on top of the work surface 30. The shield 70 is positioned over a cutting tool opening 45, best seen in FIG. 4, defined in the work surface 30. As also seen in FIG. 4, the squaring guide 60 includes a first member 61 which is preferably mounted perpendicular to a second member 62 on the work surface 30. Each member 61,62 of the squaring guide projects upward perpendicular to the work surface 30. The cutting tool shield 70, which is disposed over the cutting tool opening 45, is preferably positioned between the squaring guide members 61,62. The work surface 30, squaring guide 60, cutting tool shield 72, and one or more clamping members, described in greater detail below, are generally referred to herein as a work assembly.

The squaring guide members 61, 62 may be formed from metal or other rigid material. In the preferred embodiment shown in FIGS. 2 and 4, the members are comprised of a bottom flange 63 which is planar and mounted on the work surface 30. Rising essentially perpendicular from the planar bottom flange 63 is an upper flange 64 which serves to contact the planar member to be cut, thereby acting as a guide for the planar member. Referring to FIGS. 2 and 4, the first squaring guide member 61 is preferably mounted with its outer end 65 located approximately in the middle of the outer edge of the work surface 30 and the central end 66 terminating near the center of the work surface 30. The second member 62 has its outer end 67 mounted approximately in the middle of the adjacent outer edge of the work surface 30. The central end 68 of the second member 62 also terminates near the center of the work surface 30. The lines formed between the points 65–66 and 67–68 intersect perpendicular to one another at the corner 75, or approximately so, of the cutting shield 70. Such positioning of the members allows the squaring guide 60 to function as a guide and align the planar member over the cutting tool opening 45. The minimum height of the squaring device members 61,62 is such that the members 61, 62 are able to serve as a guide for the placement of the planar member. The minimum length, that is the distance between outer ends 65, 67 and the central ends 66, 68 of the squaring device member 60, is determined to ensure that the planar member does not rotate while its corner is being rounded. The preferred length of each of the first and second members 61 and 62 is approximately half the width of the outer edge of the work surface 30.

As shown in FIGS. 2 and 4, the clamping devices 50 are preferably mounted on the work surface near the middle of the squaring guide members 61,62 along the outside perimeter of the region defined by the squaring guide members 61,62 and the edges of the work surface 30. The clamping device 50 used in the preferred embodiment is a toggle clamp, best viewed in FIG. 4, comprised of a handle 52, an arm 53, a pivot point 54 and a clamping foot 55. Although a toggle clamp is used in the preferred embodiment, any means that can exert the required force to firmly hold the planar member in place while its corner is being shaped will suffice. The clamping devices 50 may be operated either manually, pneumatically or hydraulically. More than one clamping device 50 can be used when additional pressure is needed to hold the planar member firmly in place while the corner of the planar member is being shaped.

Figure 8:
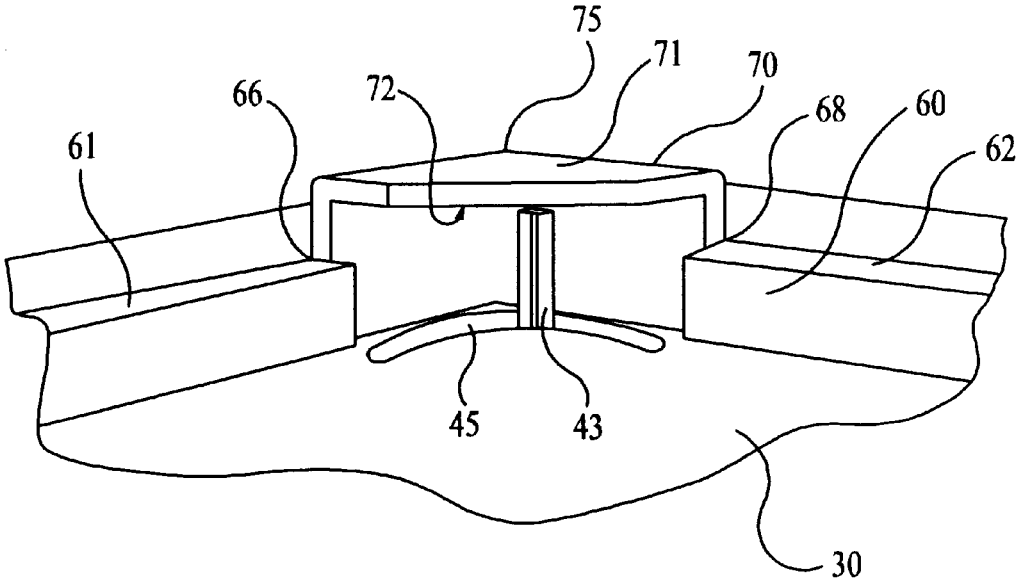
FIG. 8 is a detailed partial perspective view along the work surface of the preferred embodiment apparatus, illustrating the cutting tool extending through an opening provided in the work surface.

Referring to FIG. 2, the cutting tool shield 70 is comprised of a substantially planar platform 76 extending outward from the area defined by the squaring guide 60 and the outer edges of the work surface 30. Extending upwardly and essentially perpendicular to the platform 76, are two rear walls 74. The two rear walls 74 converge at one common end to form a right angle, or approximately so, at the corner 75 of the shield 70 which is also preferably located generally along the intersection of the squaring guide members 61, 62. The other end of the rear wall 74 adjoins the central ends 66, 68 of the squaring guide members 61, 62. The top 71 of the cutting tool shield 70, mounted on the rear walls 74, forms a small hood or enclosure over the cutting tool 43 and cutting tool opening 45. The cutting tool shield 70 is preferably made from metal, or a rigid, hard plastic or other suitable material. The difference in height between the inside 72 (see FIG. 8) of the top 71 of the cutting tool shield 70 and the work surface 30 is sufficient to receive and accommodate the planar member while its corner is being rounded. FIG. 8 illustrates in detail the preferred arrangement and orientation of the squaring guide 60, shield 70, cutting tool 43, and opening 45.

As shown in FIG. 8 the cutting tool opening 45 is preferably arcuate in shape. However, as noted herein, it will be understood that the cutting tool opening 45 may be in the form of other shapes. The cutting tool opening 45 is wide enough to allow the cutting tool 43 to protrude freely upward through the work surface 30. The cutting tool opening 45 is defined near the middle of the work surface to allow an adequate amount of the planar member to be supported on the work surface while the corner of the planar member is being rounded. The cutting tool shield 70, cutting tool 43, cutting tool opening 45 and motor 40 are all preferably oriented longitudinally along a common vertical axis. In another embodiment, the cutting tool opening 45 may be of a different shape than arcuate. The cutting tool opening 45 could have a rectangular, triangular, or circular shape, as long as the cutting tool 43 protrudes freely through the work surface 30.

Figure 9:
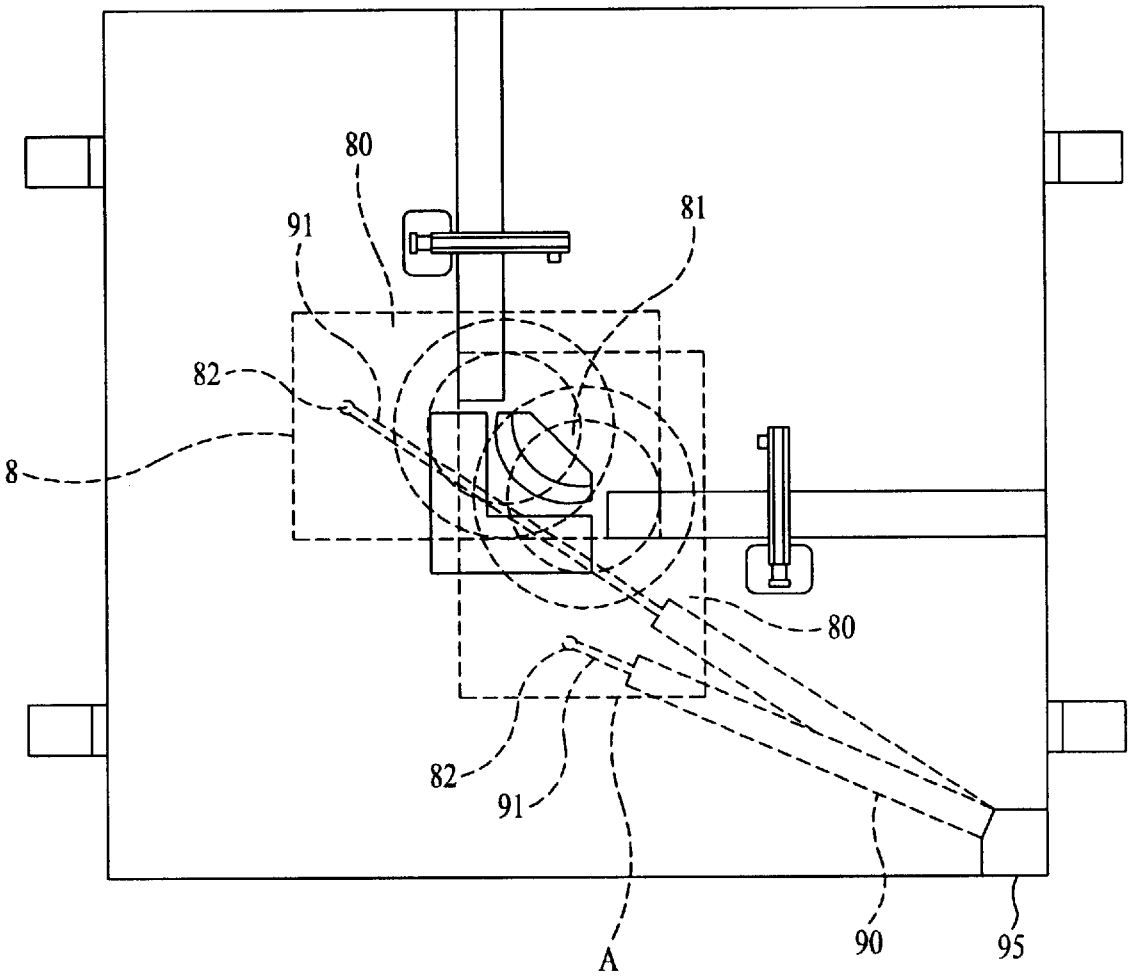
FIG. 9 is a top view of the work surface in the preferred embodiment illustrating, in phantom, a pivotally mounted plate rotating about a pivot point.

FIGS. 3, 4, 6, and 9 illustrate a pivotally fastened plate 80 mounted underneath the work surface 30. The plate may be moved or rotated about a pivot point 81 generally within a horizontal plane parallel to the work surface 30. The location of the pivot point 81 is defined by the radius of the corner of the planar member to be shaped. The distance between the cutting tool 43 and the pivot point 81 defines the arcuate path that the cutting tool 43 will travel when the pivotally fastened plate 80 is rotated. FIG. 4 shows one pivot point 81 in phantom defined by the desired shape of the corner to be formed in the planar member. FIG. 9 shows the preferred embodiment where the pivotally fastened plate 80 rotates about the pivot point 81 between position A and position B. However, in another embodiment more than one pivot point 81 may be provided and provisions to allow the pivotally fastened plate 80 to be moved to a desired pivot point. This configuration enables a wide variety of additional shapes of corners to be formed.

The pivotally fastened plate 80 is fastened at a pivot point 81 allowing the plate 80 to rotate causing the motor 40 to pivot or move in an arcuate path about point 81, which thereby causes the cutting tool 43 to travel along the path of the arcuate cutting tool opening 45. The pivotally fastened plate 80 is preferably formed from a rectangular piece of metal or other suitable material sufficiently rigid to support the motor 40 along the underside of the work surface 30. The pivotally fastened plate 80 need not be rectangular, however the plate 80 must be large enough to have a motor 40 mounted underneath the plate 80, and provide an attachment point 82 for the extension and retraction device and accommodate the pivot point 81. While being large enough to accommodate the preceding items, the pivotally fastened plate 80 should be small enough to move freely underneath the work surface 30 without having its movement impeded by contact with the support structure 10.

Figure 6:
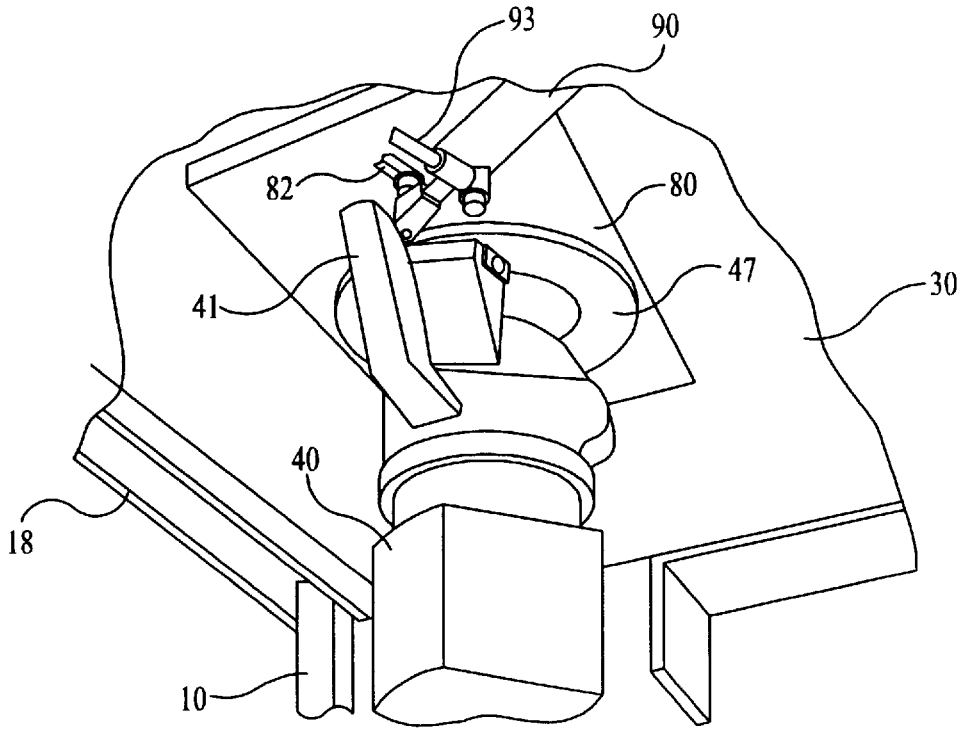
FIG. 6 is a detailed view of the underside of the work surface in the preferred embodiment apparatus illustrating a motor and cutting tool utilized therein.
Figure 7:
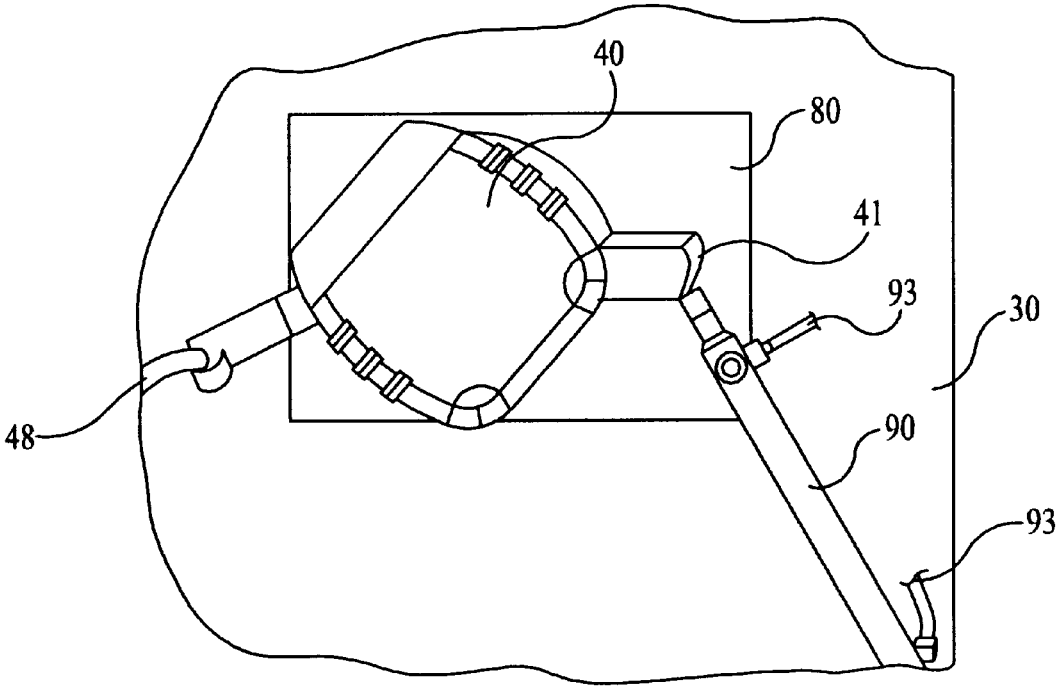
FIG. 7 is a view of the motor and cutting tool disposed along the underside of the work surface of the preferred embodiment apparatus.

The motor 40, which drives the cutting tool 43, is preferably mounted underneath and to the pivotally fastened plate 80. The motor preferably includes a vertical alignment plate 47 to ensure that the cutting tool 43 is aligned perpendicular to the work surface 30. The motor 40 in the preferred embodiment apparatus is a commercially available router having sufficient horsepower to round, shape, or otherwise form the planar member, however other types of motorized cutting devices may be used. As shown in FIGS. 1 and 6, a commercially available router typically has handles 41 attached to it. Care must be taken to ensure that the handles 41 will not contact the support structure 10 when the pivotally mounted plate 80 rotates to form the corner of the planar member. FIGS. 1, 3 and 7 illustrate the preferred embodiment, in which an electrical cord 48 provides energy to the motor 40. However, a cordless battery powered configuration or other power supply may be used.

The cutting tool 43 protrudes up from the motor 40 through the work surface 30. In the preferred embodiment, the cutting tool is a router bit long enough to extend through the pivotally fastened plate 80 and the work surface 30. The type of cutting tool 43 used is determined by the type of material to be shaped or otherwise formed or cut.

Figure 5:
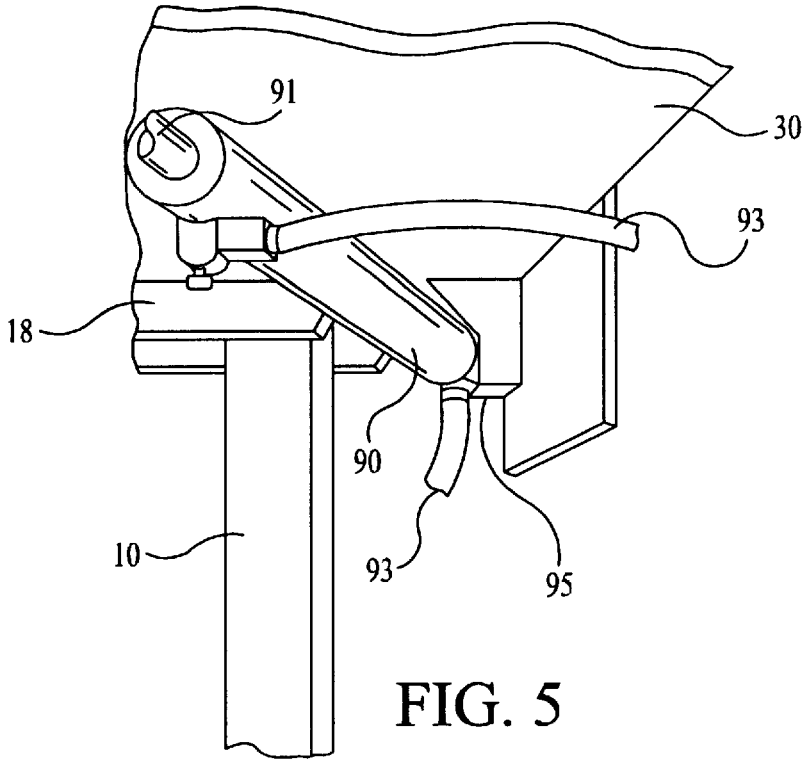
FIG. 5 is a detailed view of a pneumatically actuated component utilized in the preferred embodiment apparatus.

The pivotally mounted plate 80 preferably is positioned by a pneumatic cylinder 90, as best shown in FIGS. 3, 5 and 9. The cylinder 90 includes a powered or pressurized extension and retraction device 91, such as a ram. The cylinder 90 is also pivotally mounted, allowing horizontal arcuate movement, to a securing block 95 underneath the work surface 30, as shown in FIG. 5. The securing block 95 shown in the preferred embodiment has a cubical shape, however the shape is not as important as the securing block's ability to provide adequate support for the dual action cylinder 90. The securing block 95 is preferably mounted near a corner of the underside of the work surface 30. The securing block 95 in other embodiments of the invention could also be mounted to other areas of the work surface in order to accommodate another desired path of the cutting tool 43. The cylinder 90 provides adequate force for the extension and retraction device 91 to rotate the pivotally mounted plate 80 thereby allowing the cutting tool 43 to move along its arcuate path. The extension and retraction device 91 of the cylinder 90 is connected to the pivotally fastened plate 80 at an attachment point 82 on the plate 80, as illustrated in FIGS. 6 and 9. The attachment point 82 provided on the pivotally fastened plate 80 allows the extension and retraction device 91 to slightly glide from side to side as it extends and retracts moving the pivotally mounted plate 80. FIG. 9 shows the preferred embodiment where the extension and retraction device 91 is fully retracted in position A and fully extended in position B. FIG. 9 also shows the need of having the cylinder 90 pivotally mounted to the securing block 95 so that the plate 80 can rotate about the point 81.

As seen in FIG. 7, the preferred embodiment of the present invention uses one dual action cylinder 90 to rotate or otherwise move the pivotally fastened plate 80. In the preferred embodiment, one or more air hoses 93 shown in FIGS. 1, 5, 6, and 7 operate the pneumatic cylinder 90. Conventional pneumatic controls and components are used such as air pressure regulators and valving to operate and control the pneumatic circuit. Along with pneumatic operation, the pivotally fastened plate 80 may be selectively moved by using a hydraulic circuit. Also, besides using one dual action cylinder, two cylinders may be used acting in tandem to rotate the pivotally fastened plate 80 so that the cutting tool 43 can move along its defined path and shape the corner of the planar member. In addition, the pivotally fastened plate and associated hardware may be moved and positioned by electrical means.

The foregoing description is, at present, considered to be the preferred embodiments of the present invention. However, it is contemplated that various changes and modifications apparent to those skilled in the art, may be made without departing from the present invention. Therefore, the foregoing description is intended to cover all such changes and modifications encompassed within the spirit and scope of the present invention, including all equivalent aspects.

What is claimed is:

1. An apparatus for shaping corners on a planar member, said apparatus comprising:

a support structure;

a work assembly affixed to and disposed on said support structure, said work assembly including (i) a work surface defining a top surface for contacting said planar member and a cutting tool opening through the thickness of said work surface, (ii) a squaring guide secured along said top surface of said work surface, and (iii) a cutting tool shield secured on said top surface of said work surface and disposed over said cutting tool opening;

a movable plate disposed underneath said work surface and generally movable in a plane parallel to said work surface;

an actuating assembly coupled to said movable plate, wherein upon actuation of said actuating assembly, said plate is moved underneath said work surface; and a motor and cutting tool affixed to said movable plate, said motor and said cutting tool oriented and positioned under said work surface such that said cutting tool extends upward through said cutting tool opening defined in said work surface.

2. The apparatus of claim 1 wherein said cutting tool opening has an arcuate shape.

3. The apparatus of claim 1 wherein said work assembly further includes (iv) at least one clamping device capable of securing the planar member firmly to said work surface while the corner of the planar member is being shaped.

4. The apparatus of claim 1 wherein said actuating assembly includes an air cylinder, and an extension and retraction ram.

5. The apparatus of claim 4, wherein said ram is coupled between said movable plate and said work surface.

6. An apparatus for forming rounded corners on a planar member, said apparatus comprising:

a support structure having a plurality of frame members;

a generally planar work surface disposed on and affixed to said support structure, said work surface defining a top surface and a cutting tool opening;

a squaring guide disposed on said top surface of said work surface;

a cutting tool shield disposed on said top surface of said work surface and positioned over said cutting tool opening;

a pivotable member affixed underneath and to said work surface, said pivotable member movable within a horizontal plane generally parallel to said work surface;

a selectively extendable member coupled between said pivotable member and said support structure, wherein upon extension of said selectively extendable member, said pivotable member is moved through an arc within said horizontal plane generally parallel to said work surface; and a cutting assembly adapted to cut or otherwise form material, said cutting assembly affixed to said pivotable member such that said cutting assembly also moves through an arc within said horizontal plane generally parallel to said work surface upon extension of said selectively extendable member.

7. The apparatus of claim 6 wherein said squaring guide includes a first squaring guide member disposed on said work surface and a second squaring guide member disposed on said work surface, said first and second squaring guide members oriented perpendicular to each other.

8. The apparatus of claim 7 wherein said cutting tool shield is disposed between said first and second guide members.

9. The apparatus of claim 6 further comprising:

a clamping device secured to said work surface and extending upward from said top surface of said work surface, said clamping device adapted to releasably secure a planar member to be formed, to said work surface.

10. The apparatus of claim 6 wherein said selectively extendable member is a pneumatic cylinder.

11. The apparatus of claim 6 wherein said cutting assembly includes:

an electrically powered motor; and a rotary powered cutting tool in engagement with said motor, wherein said motor is secured to said pivotable member and oriented such that the axis of rotation of said motor is vertical.

12. A device adapted for forming rounded corners on a countertop, said device comprising:

a support assembly having a plurality of vertical frame members and a plurality of horizontal frame members affixed together;

a generally planar work top, said work top having an upwardly directed first face and an oppositely directed second face, said work top defining a cutting aperture extending between said first face and said second face;

a selectively positionable member movably affixed to at least one of said second face of said work top and said support assembly, and located along said work top such that said member may be selectively positioned adjacent to said cutting aperture;

an actuating assembly coupled to said selectively positionable member, a motor secured to said positionable member, said motor providing a rotary power output shaft;

a cutting tool coupled to said output shaft of said motor, said cutting tool oriented vertically and extending upward through said cutting aperture defined in said work top;

wherein upon actuation of said actuating assembly, said positionable member, said motor, and said cutting tool are selectively positioned relative to said cutting aperture defined in said work top.

13. The device of claim 12 further comprising:

a shielded enclosure disposed on said first face of said work top and positioned over said cutting aperture, said shielded enclosure sized and adapted to receive a corner of said countertop to be rounded or otherwise formed.

14. The device of claim 12 further comprising:

a squaring guide disposed on and secured along said first face of said work top, said squaring guide adapted to contact and position the countertop to be rounded or otherwise formed.

15. The device of claim 12 further comprising:

at least one clamping device adapted to releasably secure the planar member to said work top.

16. The device of claim 12 wherein said actuating assembly includes an air cylinder, a ram disposed within said cir cylinder, air lines for transferring pressurized air to and from said air cylinder, and an air supply.

* * * * *